US006471262B1

(12) United States Patent
Schwab

(10) Patent No.: US 6,471,262 B1
(45) Date of Patent: Oct. 29, 2002

(54) DEVICE FOR LOCKING A MOVEABLE PART THAT IS FITTED ONTO A MOTOR VEHICLE

(75) Inventor: Dittmar Schwab, Rodgau (DE)

(73) Assignee: Valeo GmbH & Company Schliessysteme, Neuss-Allemagne (DE)

( * ) Notice: Subject to any disclaimer, the term of this patent is extended or adjusted under 35 U.S.C. 154(b) by 0 days.

(21) Appl. No.: 09/646,565

(22) PCT Filed: Jan. 19, 2000

(86) PCT No.: PCT/FR00/00170

§ 371 (c)(1),
(2), (4) Date: Sep. 20, 2000

(87) PCT Pub. No.: WO00/43617

PCT Pub. Date: Jul. 27, 2000

(30) Foreign Application Priority Data

Jan. 20, 1999 (DE) ..... 199 02 080
Oct. 12, 1999 (DE) ..... 199 49 119

(51) Int. Cl.[7] ..... E05B 3/00

(52) U.S. Cl. ..... 292/336.3; 292/70; 292/252; 292/347; 292/348; 292/351; 292/353; 292/356; 292/DIG. 22; 292/DIG. 30; 292/DIG. 65; 70/210; 70/386; 70/484; 70/485; 242/384.6

(58) Field of Search ..... 292/336.3, 348, 292/351, 356, 353, 70, 252, 347, DIG. 22, DIG. 30, DIG. 65; 70/210, 386, 484, 485; 242/384.6

(56) References Cited

U.S. PATENT DOCUMENTS

| | | | | | |
|---|---|---|---|---|---|
| 976,328 | A | * | 11/1910 | Winne | 292/352 |
| 1,085,543 | A | * | 1/1914 | Collins | 292/353 |
| 2,046,342 | A | * | 7/1936 | Muck et al. | 292/352 |
| 2,252,855 | A | * | 8/1941 | Lasch | 292/353 |
| 2,805,094 | A | * | 9/1957 | Stoakes | 292/336.3 |
| 3,261,630 | A | * | 7/1966 | Chew | 292/169.18 |
| 3,453,015 | A | | 7/1969 | Miller | |
| 3,476,430 | A | * | 11/1969 | Widmer | 292/336.3 |
| 3,857,528 | A | * | 12/1974 | Fiala | 242/384.6 |
| 3,944,164 | A | * | 3/1976 | Tibbe | 242/384.6 |
| 4,039,158 | A | * | 8/1977 | Weman | 242/384.6 |
| 4,057,200 | A | * | 11/1977 | Ubukata et al. | 242/384.6 |
| 4,087,059 | A | * | 5/1978 | Lindblad | 242/384.6 |
| 4,371,201 | A | * | 2/1983 | Stock et al. | 292/251 |
| 4,522,350 | A | * | 6/1985 | Ernst | 242/384.6 |
| 4,534,521 | A | * | 8/1985 | Sylven | 242/384.6 |
| 4,729,523 | A | * | 3/1988 | Saitou et al. | 242/384.6 |
| 4,740,022 | A | * | 4/1988 | Takahashi | 292/217 |
| 4,898,033 | A | * | 2/1990 | Yamamoto | 73/514 |
| 5,575,516 | A | * | 11/1996 | Baumgarten | 292/353 |
| 5,622,327 | A | * | 4/1997 | Heath et al. | 242/383.4 |

FOREIGN PATENT DOCUMENTS

| | | |
|---|---|---|
| DE | 1 428 579 | 12/1968 |
| DE | 2 023 859 | 11/1971 |
| DE | 24 13 685 | 4/1975 |
| DE | 29 46 095 A1 | 5/1981 |
| DE | 4418317 | 6/1998 |
| DE | 197 56 344 A1 | 6/1999 |
| DE | 198 06 790 A1 | 8/1999 |
| DE | 198 58 415 A1 | 6/2000 |
| EP | 0 684 357 A2 | 11/1995 |

* cited by examiner

*Primary Examiner*—J. J. Swann
*Assistant Examiner*—Carlos Lugo
(74) *Attorney, Agent, or Firm*—Liniak, Beranato & White

(57) ABSTRACT

The invention relates to a device for locking a part (3; 21; 31) that is to be secured, arranged so that it can move on a motor vehicle, a securing part (11; 26; 36) engaging in a slot-shaped cavity (7; 28; 38) of the part (3; 21; 31) that is to be secured under the effect of the acceleration forces that occur when the corresponding vehicle coincides with an obstacle. To allow the device to be fitted simply and in a non-bulky way and to reliably prevent unintentional opening of the door of the vehicle when acceleration forces from different directions are applied on the part that is to be secured, the invention proposes that the securing part (11; 26; 36) be controlled by a control element (10; 22; 32) of spherical shape, the control element (10; 22; 32) resting on a guide (8; 23; 33) via domed or conical control surfaces (9).

7 Claims, 2 Drawing Sheets

DEVICE FOR LOCKING A MOVEABLE PART THAT IS FITTED ONTO A MOTOR VEHICLE

The present invention relates to a device for locking a moving part that is to be secured of a motor vehicle.

A device of this type is described in document DE-OS 1 428 579 and is used to secure motor vehicle parts, such as sliding doors, tilting seats or tilting back rests, for which there is a risk of these moving unintentionally during the operation of braking or starting the corresponding vehicle or when negotiating a bend. The known device essentially comprises a pivoting securing part which, when the vehicle motion varies, pivots under the effect of the force due to the mass and comes into engagement with a second securing part.

This known device has, among others, the drawback that the parts that are to be secured are generally locked together only when the force acting on the securing part as a result of the variation in motion acts on this part (or, as the case may be, on a mass connected to the securing part) in an entirely defined predetermined direction. The known device may admittedly be shaped in such a way as to secure the part that is to be secured, for example, against motion due to a head-on collision or against motion due to a side impact, but the known device does not allow the securing part to be activated not only in the event of a head-on collision but also in the event of a side impact. When motor vehicles roll, in particular, acceleration forces may, however, come from different directions which means that the known device is generally not able to sufficiently secure motor vehicle parts that need to be secured against the corresponding unintentional motions encountered when the corresponding vehicle collides with an obstacle.

Document DE-B 20 23 859 describes a device for locking a motor vehicle fastener, which comprises a handle guide fixed to the respective door of the motor vehicle, in which the door handle which has a handle stem projecting into the door is mounted so that it can pivot. To prevent the door from opening through pivoting of the door handle in the event of a side impact, the known device has, by way of securing part, a two-arm lever, the first arm of which takes an additional mass, and the second arm of which rests against the handle stem connected to the handle. In the event of a side impact, the additional mass exerts an inertia force multiplied according to the lever arms, which is oriented away from the inertia force acting on the handle, and therefore prevents unintentional opening.

In this known device, the additional masses needed are normally of the order of magnitude of the mass of the handle so as to compensate for the force of inertia acting on the handle in the event of a corresponding impact. Furthermore, this known device immobilizes the door handle only when the acceleration forces have corresponding components of force in the direction of opening. The acceleration forces that present themselves in the event of the vehicle being rolled do not therefore generally cause any pivoting of the securing part, which means that in such instances unintentional opening of the vehicle door cannot be precluded.

This last comment is finally also true of the device described in document DE 44 18 317 C2 for locking a motor vehicle fastener. This known device also comprises, by way of securing part, a two-arm lever of which the first arm however takes only a relatively small additional mass. The second arm of the lever engages, when the additional mass moves in the direction of opening, laterally in a slot-shaped cavity of the shaft of the handle and therefore prevents its outward displacement.

Taking as a basis document DE 44 18 317 C2, the object of the invention is a device which is manufactured in a simple and unbulky way, and which reliably prevents unintentional opening of the vehicle door even when acceleration forces coming from different directions are acting on the part that is to be secured.

The invention relies mainly on the idea that the securing part, which needs to engage in the slot-shaped cavity of the part that is to be secured, is controlled by a spherically shaped control element, the control element pressing on a guide via control surfaces of domed or frustoconical shape and being held in its normal position by means of a spring.

The securing part, which comprises an immobilizing pin tailored to the cavity of the part that is to be secured, may be shaped in such a way as to be able to perform a pivoting or translational movement.

Further details and advantages of the invention will become apparent from the following exemplary embodiments explained on the basis of the drawings, in which.

Figure 1:
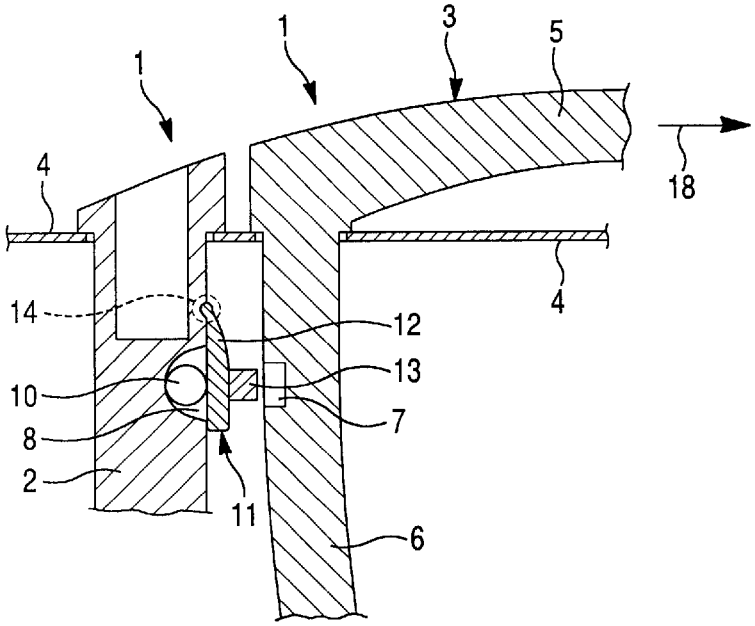
FIG. 1 is a diagrammatic depiction of the front zone of a motor vehicle door fastener with a device according to the invention arranged in a normal position.
Figure 2:
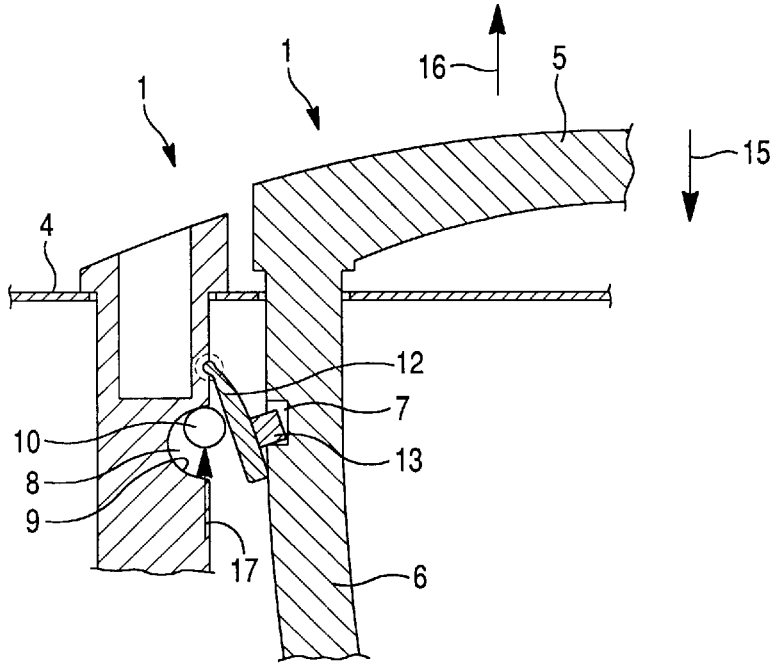
FIG. 2 depicts the motor vehicle door fastener depicted in FIG. 1, in a position in which the device according to the invention is locked.

In FIGS. 1 and 2, the notation 1 denotes the front zone of an exterior door handle for the side door of a motor vehicle. The exterior door handle 1 of the door essentially consists of a handle guide 2 and of the actual handle 3, the handle guide being driven into the outer door panel denoted by the notation 4 and secured thereto.

The handle 3 comprises a handle bow 5, which can pivot outward so as to open the vehicle door, and a handle stem 6 connected to the handle bow and projecting into the door and collaborating, via connecting parts which have not been depicted, with the door lock which is also not depicted. Furthermore, the handle stem 6 laterally contains a slot-shaped cavity 7, the purpose of which will be explained in greater detail hereinafter.

Formed in the handle guide 2 is a cavity 8 shaped as a guide with a control surface 9 in the shape of a spherical cup, in which a spherically-shaped 15 control element 10 is arranged. This element is held in its normal position by a securing part 11 urged by a spring into the position depicted in FIG. 1. The securing part 11 essentially consists of a lever 12 with just one branch, on the side of which lever 20 facing the slot-shaped cavity 7 of the handle stem 6 an immobilizing pin 13 is arranged. As regards the torsion spring 14 which keeps the lever 12 in its starting position, this in the embodiment depicted is a torsion spring.

The way in which the device according to the invention works will be explained hereinbelow. In this particular instance, it will be assumed that the device starts out in its normal position depicted in FIG. 1. A side impact indicated by the arrow 15 (FIG. 2) on the door of the motor vehicle will produce on the handle 3 a force due to the mass acting in the direction of the arrow 16.

As a corresponding force due to the mass (arrow 17) also acts on the spherically-shaped control element 10, this element is pressed against the control surfaces of the guide cavity 8 and therefore also against the lever 12. The latter is subjected to pivoting against the pressure of the torsion spring 14 and the immobilizing pin 13 is pressed into the slot-shaped cavity 7 of the handle stem 6 (FIG. 2) so that the handle bow 5 cannot pivot and so that the door fastener becomes immobilized in its locked position.

It is immediately apparent from FIGS. 1 and 2 that, because of the spherical cup shape of the control surfaces 9 of the guide cavity 8 for the control element 10, the forces of acceleration acting on the control element 10 at right angles to the force due to the mass indicated by the arrow 17 also give rise to a translational movement of the immobilizing pin 13 into the slot-shaped cavity 7 of the handle stem 6.

Likewise, when the motor vehicle is traveling in the direction of the arrow 18 (FIG. 1) and encounters an obstacle (head-on collision), the immobilizing pin 13 will be moved in the slot-shaped cavity 7 because of the force of inertia of the control element 10.

It will only be in the event of a rear impact that no locking of the handle bow 5 will occur. In consequence if, in the exemplary embodiment depicted, the handle also needs to be locked in the event of a rear impact, an additional device would need to be arranged, for example, on the opposite side of the handle stem 6 to the cavity 8.

Naturally, the invention is not restricted to the exemplary embodiment described hereinabove. Thus, for example, the securing part controlled by the spherically-shaped control element does not necessarily have to be in the form of a pivoting lever but may just as easily be mounted in such a way that it can also perform a translational movement. A representative illustrative embodiment is illustrated in FIG. 3, which depicts a partial zone of a fastener cylinder shaped as a push-button for the tail gate of a motor vehicle.

Figure 3:
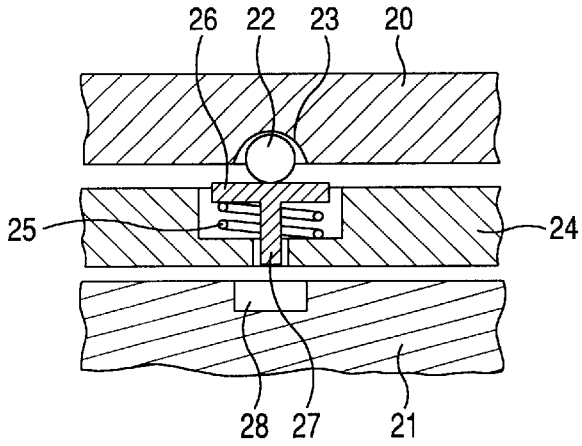
FIGS. 3 and 4 depict two other exemplary embodiments of the device according to the invention.

In FIG. 3, the notation 20 denotes the sleeve of a fastener cylinder and the notation 21 denotes the plug of the corresponding fastener cylinder which can move in the sleeve. In the sleeve 20 of the cylinder there is a cavity 23 in the shape of a spherical cup shaped as a guide for the spherically-shaped control element 22. The control element 22 is pressed by its side which faces the plug 21 of the cylinder against the securing part 26 arranged in such a way as to be able to perform a translational movement in a guide part 24 and urged by a compression spring 25 by means of an immobilizing pin 27. In this particular instance, the guide part 24 and the sleeve 20 of the cylinder are secured to each other.

When the control element 22 is displaced from its normal position by a high corresponding acceleration force, this element presses the immobilizing pin 27 into a slot-shaped cavity 28 in the plug 21 of the cylinder and therefore prevents any displacement of the cylinder plug and, in consequence, unintentional opening of the rear fastener.

Figure 4:
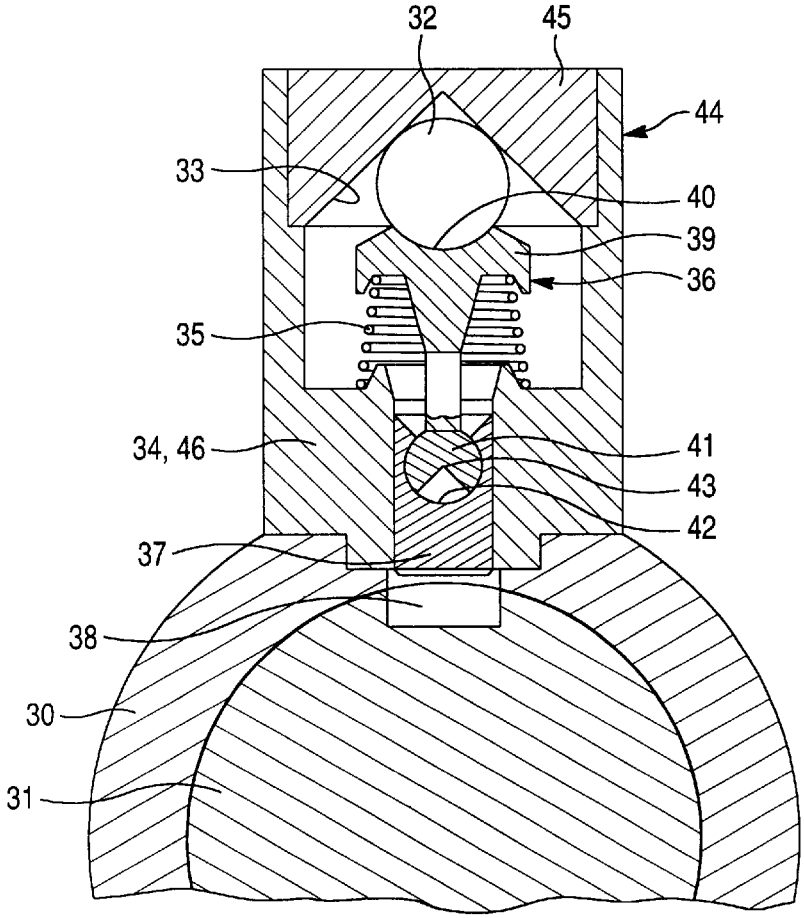

FIG. 4 depicts another exemplary embodiment of the invention, in which embodiment the securing part is shaped in such a way as to be just as capable of a pivoting movement as it is a translational movement. In this particular instance, the notation 30 once again denotes the cylinder sleeve of a fastener cylinder and the notation 31 denotes a cylinder plug which can move in the plane of the drawing. A spherically-shaped control element 32 presses against a conically-shaped guide 33 and acts, via a securing part 36 urged by a spring 35, on an immobilizing pin 37 arranged in a guide part 34. This part engages, when the corresponding acceleration forces occur, in a slot-shaped cavity 38 in the cylinder plug and therefore prevents any movement of the cylinder plug and, as a result, for example, unintentional opening of the rear fastener of a motor vehicle door.

The securing part 36 has, on its first end 39 facing the control element 32, a cavity 40 in the shape of a spherical cup tailored to the surface of the control element 32. On its second end 41 facing the immobilizing pin 37, the securing part 36 has a spherical shape and fits via this end, with mating shapes, into a corresponding cavity 42 in the immobilizing pin 37. The securing part 36 is furthermore designed to be able to pivot about an axis 43 passing through the central point of its spherically-shaped end 41 so that, as the control element 32 effects a lateral translation governed by the guide 33, the first end 39 of the securing part also moves laterally into a predetermined final position and, at the same time, the immobilizing pin 37 is moved into the slot-shaped cavity 38.

In the exemplary embodiment depicted in FIG. 4, the control element 32, the securing part 36 with the spring 35 and the immobilizing pin 37 are preferably arranged together in a casing 44 fixed to the cylinder sleeve 30, the interior surface of the wall 45 of the casing 44, against which the control element 32 is pressed by the spring 35, being shaped as a guide 33, and the opposing wall 46 of the casing 44 forming the guide part 34 for the immobilizing pin 37.

LIST OF REFERENCES

1 Door exterior handle
2 Handle guide, stationary part
3 Handle, part to be secured
4 Door exterior panel
5 Handle bow
6 Handle stem
7 Slot-shaped cavity
8 Guide cavity
9 Control surface
10 Control element
11 Securing-part
12 Lever
13 Immobilizing pin
14 Spring, torsion spring
15–18 Arrows
20 Cylinder sleeve
21 Cylinder plug
22 Control element
23 Guide cavity
24 Guide part
25 Spring, compression spring
26 Securing part
27 Immobilizing pin
28 Slot-shaped cavity
30 Cylinder sleeve
31 Cylinder plug
32 Control element
33 Guide cavity
34 Guide part
35 Spring, compression spring
36 Securing part
37 Immobilizing pin
38 Slot-shaped cavity
39 First end
40 Spherical cup shaped cavity
41 Spherical second end
42 Cavity
43 Axis
44 Casing
45–46 Walls

What is claimed is:

1. A device for locking a part (3; 21; 31) that is to be secured in a stationary part (2;20; 30), said part being arranged on a motor vehicle so that it can move, said device comprising:

a) a spherically-shaped control element (10; 22; 32), a cavity (8; 23; 33) shaped as a guide for the control element (10; 22; 32) which is arranged with respect to the part (3; 21; 31) that is to be secured in said stationary part (2; 20; 30) of the motor vehicle, and a spring (14; 25; 35) which pushes into the guide (8; 23; 33) the control element (10; 22; 32) when the control element (10; 22; 32) is in a normal position;

b) the guide (8; 23; 33) for the control element (10; 22; 32) has control surfaces (9) of domed or conical shape which cause a translational movement of the control element (10; 22; 32) toward the part (3; 21; 31) that is to be secured against the action of the pressure of the spring (14; 25; 35) when the vehicle experiences a predetermined variation in motion;

c) the part (3; 21; 31) that is to be secured contains, on its side facing the control element (10; 22; 32), a slot-shaped cavity (7; 28; 38), and d) the control element (10; 22; 32) is connected, on a side facing the part (3; 21; 31) that is to be secured, a securing part (11; 26; 36) which acts on an immobilizing pin (13; 27; 37) tailored to the slot-shaped cavity (7; 28; 38) so that the immobilizing pin (13; 27; 37) fits into the slot-shaped cavity (7; 28; 38) when there is a corresponding translational movement of the control element (10; 22; 32).

2. The device as claimed in claim 1, wherein the securing part (11) is a pivoting lever (12).

3. The device as claimed in claim 1, wherein the securing part (26) is mounted in such a way as to be able to effect an axial translational movement in a guide part (24).

4. The device as claimed in claim 3, wherein:

the securing part (36) has, at a first end (39) facing the control element (32), a cavity (40) in the shape of a spherical cup tailored to the surface of the control element (32) and at a second end (41) facing the locking pin (37) has a spherical shape, the spherically-shaped end (41) fits, with mating shapes, into a corresponding cavity (42) in the immobilizing pin (37), the securing part (36) is urged by a spring (35) which presses the first end (39) against the control element (32). and presses the latter against the guide (33), and the securing part (36) is arranged in such a way as to be able to pivot about an axis (43) passing through the central point of its spherically-shaped end (41) so that, upon a lateral movement of the control element (32) governed by the guide (33), the first end (39) of the securing part can also move laterally into a predetermined final position.

5. The device as claimed in claim 4, wherein the control element (32), the securing part (36) equipped with the spring (35) and the immobilizing pin (37) are arranged together in a casing (44), the interior surface of a wall (45) of the casing (44) against which the control element (32) is pressed by the spring (35) being shaped as a guide (33), and an opposing wall (46) of the casing (44) forming the guide part (34) for the immobilizing pin (37).

6. The device as claimed in claim 1, wherein, to lock a fastener of a motor vehicle door which has a handle (3) mounted to pivot in a handle guide (2), which has a handle stem (6) projecting into the vehicle door, the guide-shape cavity (8) of the spherically shaped control element (10) is arranged in the handle guide (2), and the slot-shaped cavity (7) is arranged in the handle stem (6).

7. The device as claimed in claim 1, wherein, to lock a fastener of a motor vehicle door with a cylinder plug (21; 31) shaped as a push-button in a cylinder sleeve (20; 30), the guide-shaped cavity (23; 33) of the spherically-shaped control element (22; 32) is arranged in the cylinder sleeve (20) or in the wall (45) of a casing (44) connected to the cylinder sleeve, and the slot-shaped cavity (28; 38) is arranged in the cylinder plug (21; 31).

* * * * *